US009754522B2

(12) United States Patent
Park et al.

(10) Patent No.: US 9,754,522 B2
(45) Date of Patent: Sep. 5, 2017

(54) CURVED DISPLAY DEVICE AND LUMINANCE CORRECTION METHOD FOR DRIVING THE SAME

(71) Applicant: Samsung Display Co., Ltd., Yongin, Gyeonggi-Do (KR)

(72) Inventors: Young Min Park, Hwaseong-si (KR); Sang Ho Hwang, Suwon-si (KR); Ju Hee Song, Anyang-si (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 72 days.

(21) Appl. No.: 14/631,154

(22) Filed: Feb. 25, 2015

(65) Prior Publication Data

US 2016/0027364 A1 Jan. 28, 2016

(30) Foreign Application Priority Data

Jul. 22, 2014 (KR) ..... 10-2014-0092624

(51) Int. Cl.
*G09G 5/10* (2006.01)
*G09G 3/20* (2006.01)

(52) U.S. Cl.
CPC ..... *G09G 3/20* (2013.01); *G09G 2320/0233* (2013.01); *G09G 2320/0285* (2013.01); *G09G 2380/02* (2013.01)

(58) Field of Classification Search
CPC ..... G09G 3/2003; G09G 2320/0285; G09G 2320/0233; G09G 2380/02; G06F 1/1652
See application file for complete search history.

(56) References Cited

U.S. PATENT DOCUMENTS 7,834,889 B2 * 11/2010 Mizoguchi ..... G09G 3/3611 345/606
2006/0109391 A1 * 5/2006 Huitema ..... G09G 3/3611 349/19
2011/0102390 A1 * 5/2011 Moriwaki ..... G09G 3/3208 345/207
2012/0206504 A1 8/2012 Ha et al.
2013/0201180 A1 8/2013 Jeon et al.
(Continued)

FOREIGN PATENT DOCUMENTS

KR 10-2012-0010009 2/2012
KR 10-2012-0092982 8/2012
KR 10-2013-0090211 8/2013

*Primary Examiner* — Rodney Amadiz
(74) *Attorney, Agent, or Firm* — Robert E. Bushnell, Esq.

(57) ABSTRACT

A display device includes a curvature-variable display panel including a plurality of pixels; a controller configured to correct and output an image signal supplied from the outside according to a radius of curvature of the display panel; a data driver configured to supply a data signal corresponding to the corrected image signal to a data line connected to the pixel; and a scan driver configured to supply a scan signal synchronized with the data signal to a scan line connected to the pixel. The controller may include a curvature detector configured to detect the radius of curvature of the display panel and a lookup table generator configured to generate a correction lookup table according to the radius of curvature of the display panel.

9 Claims, 7 Drawing Sheets

(56) References Cited

U.S. PATENT DOCUMENTS

| | | | | |
|---|---|---|---|---|
| 2013/0215041 | A1* | 8/2013 | Kim | G06F 3/0487 345/173 |
| 2013/0321373 | A1* | 12/2013 | Yoshizumi | G09G 5/00 345/211 |
| 2014/0118319 | A1* | 5/2014 | Jeon | G06F 1/00 345/207 |
| 2014/0168202 | A1* | 6/2014 | Bae | G06F 1/1652 345/214 |
| 2014/0306985 | A1* | 10/2014 | Jeong | G09G 3/3233 345/601 |
| 2015/0097858 | A1* | 4/2015 | Miki | G06T 3/005 345/629 |
| 2016/0078592 | A1* | 3/2016 | Kim | G06F 3/013 345/619 |
| 2016/0140919 | A1* | 5/2016 | Yim | G09G 3/3648 345/89 |

* cited by examiner

CURVED DISPLAY DEVICE AND LUMINANCE CORRECTION METHOD FOR DRIVING THE SAME

CLAIM OF PRIORITY

This application makes reference to, incorporates the same herein, and claims all benefits accruing under 35 U.S.C. §119 from an application earlier filed in the Korean Intellectual Property Office on 22 Jul. 2014 and there duly assigned Serial No. 10-2014-0092624.

BACKGROUND OF THE INVENTION

Field of the Invention

Embodiments of the present disclosure of invention relate to a display device improved in luminance deviation caused when a radius of curvature of a curvature-variable display panel is changed and to a method of driving the display device.

Description of the Related Art

A liquid crystal display (LCD) panel includes two substrates including electrodes formed thereon and a liquid crystal layer interposed therebetween. The LCD panel produces an electric field by applying voltage to the two electrodes, and liquid crystal molecules of the liquid crystal layer are rearranged by adjusting strength of the electric field, thereby adjusting an amount of transmitted light.

Further, a display panel using an organic light emitting diode (OLED) is different from the LCD panel, in that the OLED display device includes a light emitting diode and can be manufactured to have a thin-film laminated structure, thereby achieving excellent flexibility. Accordingly, the OLED has drawn attention as a flexible panel display.

Generally, a display panel using the LCD panel or the OLED may have smears of brighter or darker luminance than surrounding areas produced in abnormal processes in a manufacturing process, which results in display quality deterioration.

In a curvature-variable display panel capable of adjusting a radius of curvature, as the radius of curvature of the curvature-variable display panel decreases, a center portion exhibits a higher relative luminance percentage and side surface portions exhibits a lower relative luminance percentage.

Accordingly, the curvature-variable display panel exhibits different luminance values in different areas depending on the radius of curvature, and thus a conventional smear-compensation method employed for a flat display panel has limits to compensate for smears appearing in the curvature-variable display panel.

It is to be understood that this background of the technology section is intended to provide useful background for understanding the technology and as such disclosed herein, the technology background section may include ideas, concepts or recognitions that were not part of what was known or appreciated by those skilled in the pertinent art prior to a corresponding effective filing date of subject matter disclosed herein.

SUMMARY OF THE INVENTION

Embodiments of the present disclosure of invention are directed to a display device improved in luminance deviation caused when a radius of curvature of a curvature-variable display panel is changed and to a method of driving the display device.

According to an embodiment of the present invention, a display device may include: a curvature-variable display panel including a plurality of pixels; a controller configured to correct an image signal supplied from an external source according to a radius of curvature of the display panel and output the corrected image signal; a data driver configured to supply a data signal corresponding to the corrected image signal to a data line connected to the pixel; and a scan driver configured to supply a scan signal synchronized with the data signal to a scan line connected to the pixel. The controller may include a curvature detector configured to detect the radius of curvature of the display panel and a lookup table generator configured to generate a correction lookup table according to the radius of curvature of the display panel.

The lookup table generator may generate a correction lookup table based on a plurality of reference correction data corresponding to different predetermined radii of curvatures that are premeasured.

The correction lookup table may be generated based on the plurality of reference correction data using an interpolation method.

The interpolation method may be one of linear interpolation, polynomial interpolation, and spline interpolation.

The controller may further include an image signal corrector configured to correct the image signal by multiplying correction data of the correction lookup table.

According to an embodiment of the present invention, a method of driving a display device may include: detecting a radius of curvature of a display panel; generating a correction lookup table for correcting an input image signal based on the radius of curvature; and correcting the image signal based on the correction lookup table.

The correction lookup table may be generated based on a plurality of reference correction data corresponding to different predetermined radii of curvatures that are premeasured.

The correction lookup table may be generated based on the plurality of reference correction data using an interpolation method.

The interpolation method may be one of linear interpolation, polynomial interpolation, and spline interpolation.

According to embodiments of the present invention, a display device including a curvature-variable display panel is improved in luminance uniformity in a way a plurality of reference correction data corresponding to different predetermined radii of curvatures are calculated by employing an interpolation method to generate a correction lookup table and an image signal is corrected based on the correction lookup table.

The foregoing is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
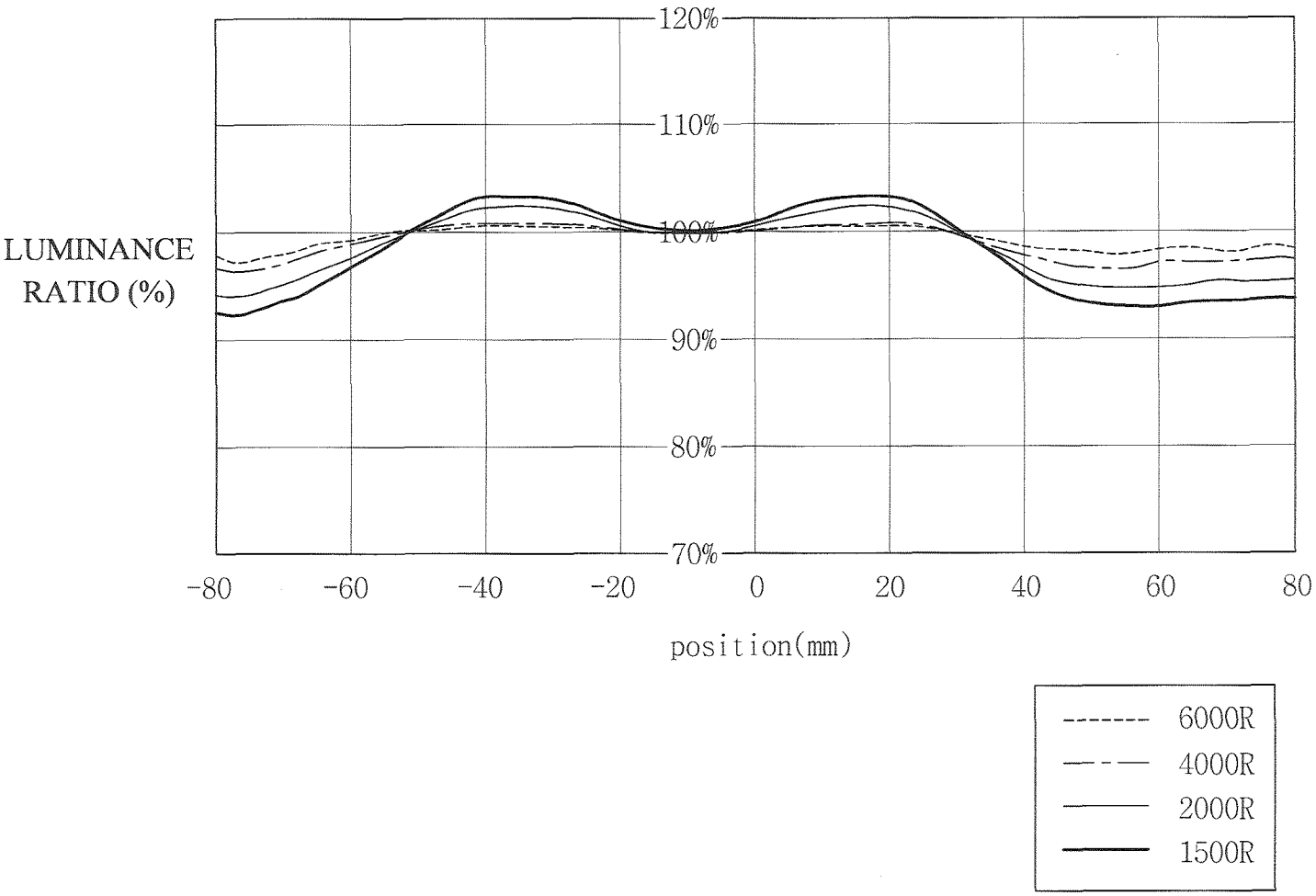
FIG. 1 is a graph illustrating a relative luminance percentage of a curvature-variable display panel in which a radius of curvature can be adjusted.

Advantages and features of the present invention and methods for achieving them will be made clear from embodiments described below in detail with reference to the accompanying drawings. The present invention may, however, be embodied in many different forms and should not be construed as being limited to the embodiments set forth herein. Rather, these embodiments are provided so that this disclosure will be thorough and complete, and will fully convey the scope of the invention to those skilled in the art. The present invention is merely defined by the scope of the claims. Therefore, well-known constituent elements, operations and techniques are not described in detail in the embodiments in order to prevent the present invention from being obscurely interpreted. Like reference numerals refer to like elements throughout the specification.

The spatially relative terms "below", "beneath", "lower", "above", "upper", and the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device shown in the drawing is turned over, the device positioned "below" or "beneath" another device may be placed "above" another device. Accordingly, the illustrative term "below" may include both the lower and upper positions. The device may also be oriented in the other direction, and thus the spatially relative terms may be interpreted differently depending on the orientations.

Throughout the specification, when an element is referred to as being "connected" to another element, the element is "directly connected" to the other element, or "electrically connected" to the other element with one or more intervening elements interposed therebetween. It will be further understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the present specification.

FIG. 1 is a graph illustrating a relative luminance percentage of a curvature-variable display panel capable of adjusting a radius of curvature R.

A radius of curvature refers to a radius of a circular arc which best approximates an outline curve of an object. An object has a flatter outline as a radius of curvature increases. In contrast, an object has a more round outline as a radius of curvature decreases.

As illustrated in FIG. 1, as the radius of curvature of the curvature-variable display panel decreases, a center portion exhibits a higher relative luminance percentage and side surface portions exhibits a lower relative luminance percentage.

Accordingly, the curvature-variable display panel exhibits different luminance values in different areas depending on the radius of curvature, and thus a conventional smear-compensation method employed for a flat display panel has limits to compensate for smears appearing in the curvature-variable display panel.

Figure 2:
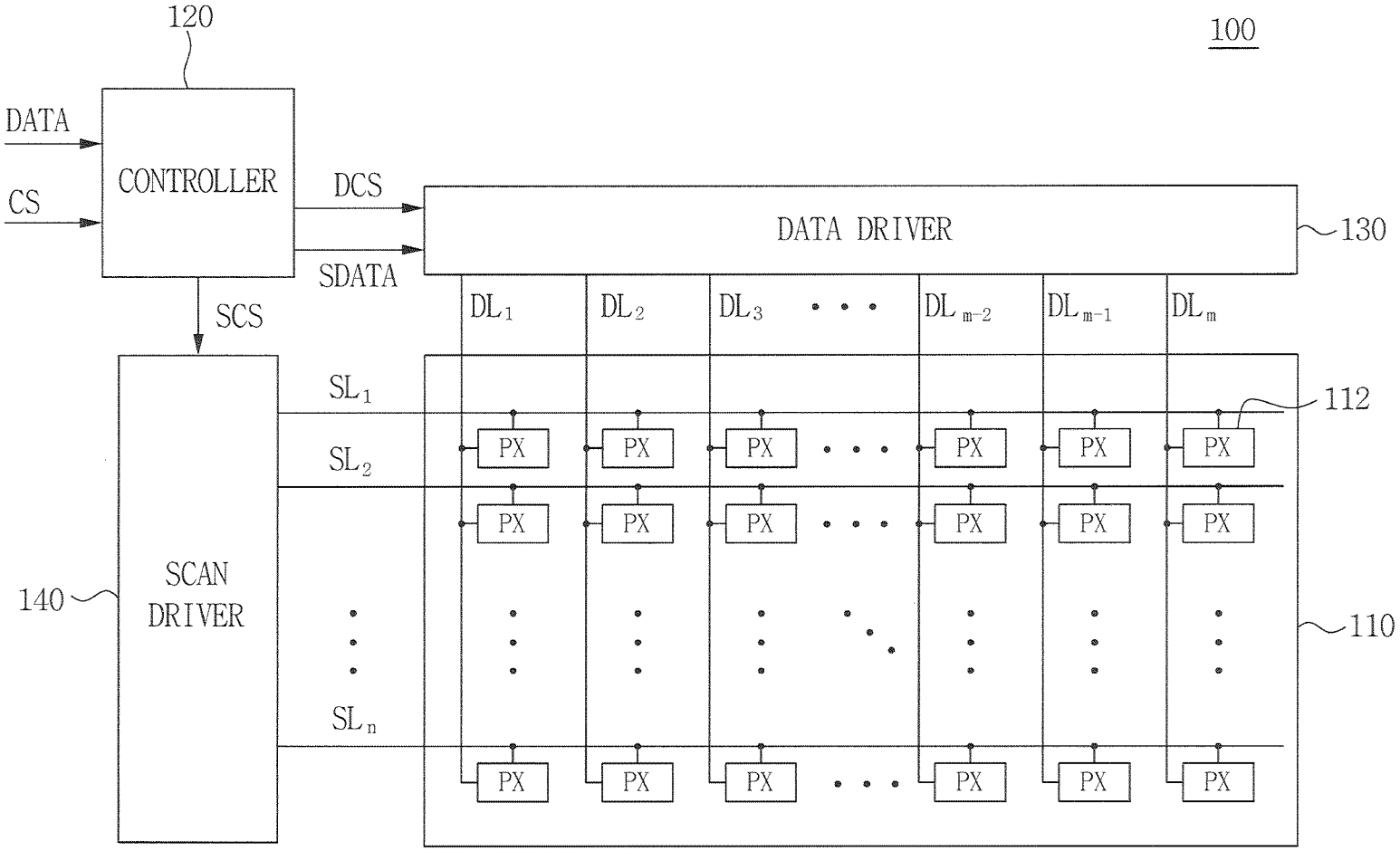
FIG. 2 is a schematic plan view illustrating a display device according to an embodiment of the present invention.

Referring to FIG. 2, a display device 100 according to an embodiment of the present invention includes a curvature-variable display panel 110 (hereinafter, 'a display panel') including a plurality of pixels 112, a controller 120 configured to correct an image signal supplied from the outside and output the image signal, a data driver 130 supplying a data signal to a data line connected to the plurality of pixels 112, and a scan driver 140 supplying a scan signal to a scan line connected to the plurality of pixels 112.

The display panel 110 is a display panel, such as an LCD panel, of which a radius of curvature can be adjusted in a predetermined range.

The display panel includes a plurality of scan lines SL1~SLn transmitting the scan signal in a row direction, a plurality of data lines DL1~DLm transmitting the data signal in a column direction, and the plurality of pixels 112 arranged in a matrix form and connected to the scan lines SL1~SLn and the data lines DL1~DLm.

Figure 3:
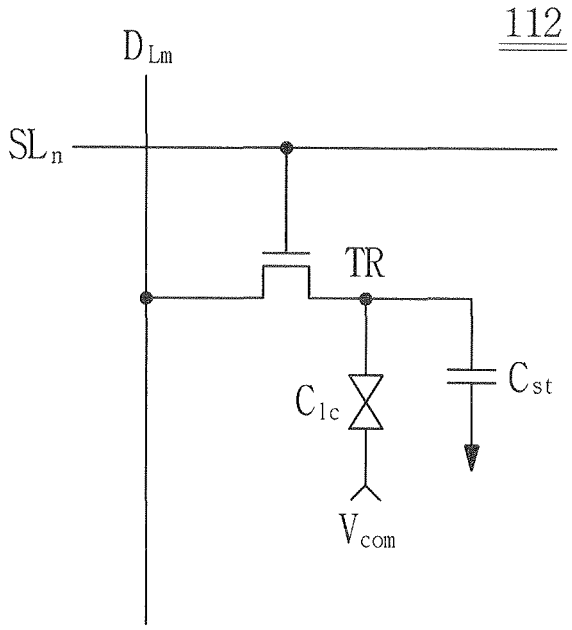
FIG. 3 is a circuit diagram illustrating a pixel circuit of the display device of FIG. 2.

FIG. 3 is a circuit diagram illustrating the pixel 112 of the display device 100 of FIG. 2. For ease of description, a pixel 112 connected to the mth data line DLm and the nth scan line SLn is illustrated.

Referring to FIG. 3, the pixel 112 is depicted as including one transistor TR and one capacitor Cst; however, embodiments of the present invention are not limited thereto, and thus one pixel may have various structures and may include a plurality of transistors and a plurality of capacitors.

The transistor TR may be a thin film transistor TFT, but embodiments of the present invention are not limited thereto.

For example, in a case where the scan signal is applied from the scan line SLn, the thin film transistor TR is turned on. Subsequently, when the thin film transistor TR is turned on, the data signal supplied from the data line DLm is applied to a pixel electrode (not illustrated) and a common voltage Vcom is simultaneously supplied to a common electrode (not illustrated), such that an electric field is formed between the pixel electrode and the common electrode. In this case, liquid crystal molecules of a liquid crystal layer are rearranged by the electric field, thereby capable of adjusting an amount of light emitted from a light source unit (not illustrated).

Referring back to FIG. 2 again, a controller 120 is configured to control the data driver 130 and the scan driver 140.

That is, the controller 120 generates a data control signal DCS and a scan control signal SCS for controlling the data driver 130 or the scan driver 140 and a corrected image signal SDATA based on an image signal DATA supplied from an external source and a control signal CS. Subsequently, the controller 120 supplies the data control signal DCS and the corrected image signal SDATA to the data driver 130 and supplies the scan control signal SCS to the scan driver 140.

For example, the control signal CS may be a timing signal, such as a vertical synchronizing signal Vsync, a horizontal synchronizing signal Hsync, a clock signal CLK, and a data enable signal DE. Further, the image signal DATA may be a digital signal representing a gray level of light emitted from the pixel 112.

A structure of the controller 120 will be described below in detail with reference to FIG. 6.

The data driver 130 receives the data control signal DCS and the corrected image signal SDATA from the controller 120 and supplies the data signal corresponding to the corrected image signal SDATA to the pixels 112 connected to the respective data lines DL1~DLm in response to the data control signal DCS.

The scan driver 140 receives the scan control signal SCS from the controller 120, generates the scan signal, and supplies the scan signal to the pixels 112 connected to the respective scan lines SL1~SLn. As the scan signals are sequentially applied to the pixels 112, the data signals can be sequentially applied to the pixels 112.

Figure 4:
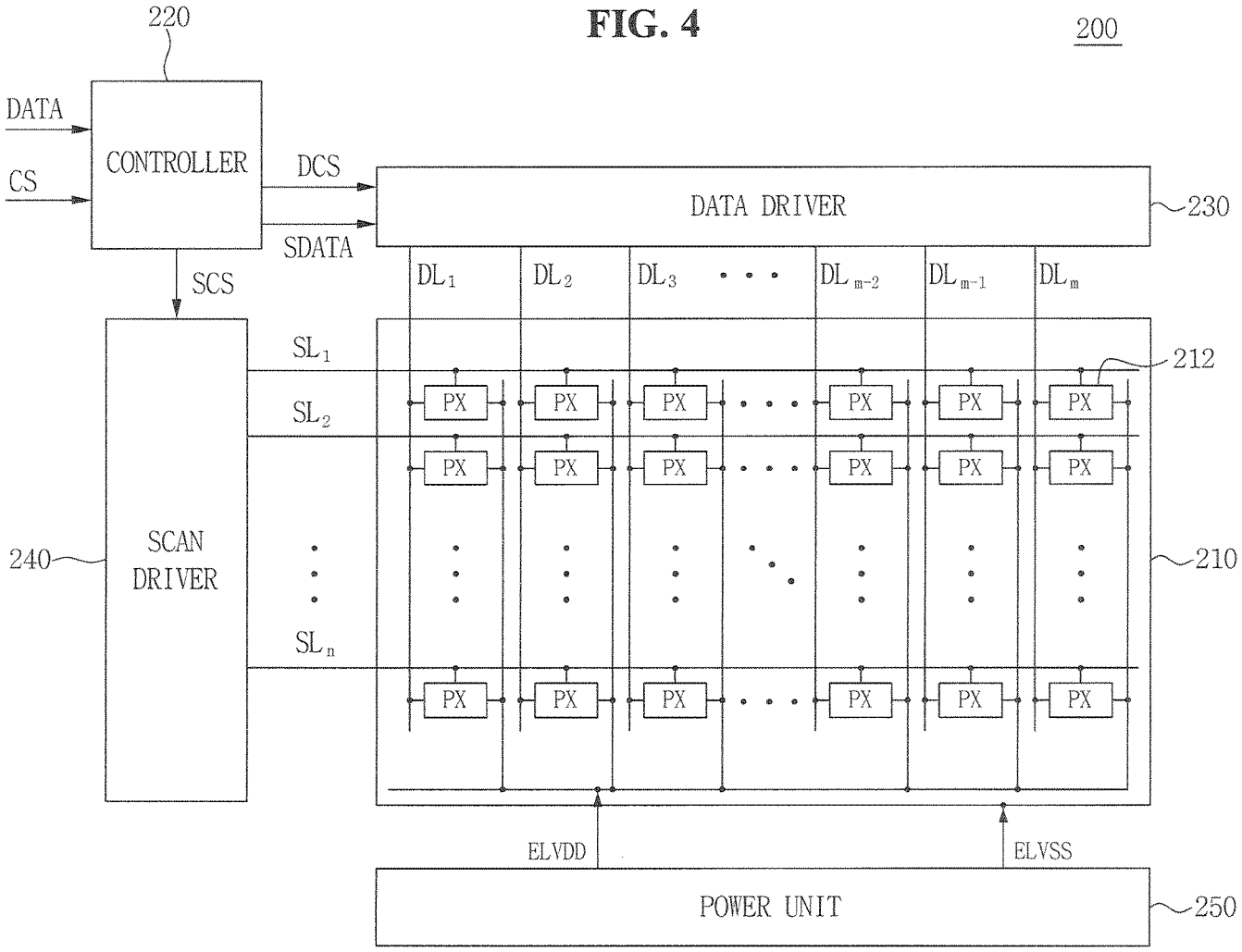
FIG. 4 is a schematic plan view illustrating a display device according to another embodiment of the present invention.

Referring to FIG. 4, a display device 200 according to another embodiment of the present invention has the same structure as the display device 100 of FIG. 2, except for a structure of a display panel 210 and an additional power unit 250. Thus, the repeated description will not be provided for ease of description.

The display panel 210 is display panel of which a radius of curvature can be differently adjusted in a predetermined range, that is, for example, a display panel including an OLED. A structure of a pixel 212 provided in the display panel 210 will be described below in detail with reference to FIG. 5.

The power unit 250 is configured to generate a driving power ELVDD and a ground power ELVSS and supply them to the display panel 210. The driving power ELVDD and the ground power ELVSS are applied to the plurality of pixels 212 of the display panel 210 together, such that the pixels 212 can emit light.

When light is emitted, a current value flowing through the pixel 212 may be determined depending on voltage values of the driving power ELVDD and the ground power ELVSS. In this case, a different current value may result in different luminance, although the same gray level is displayed.

The power unit 250 may have a single bank structure where the power unit 250 is only disposed under the display panel 210. However, embodiments of the present invention are not limited thereto, and thus the power unit 250 may have a dual bank structure where the power units 250 are respectively disposed above and under the display panel 210, in order to decrease a voltage drop by shortening lengths of power lines between the pixel 212 and the power unit 250.

Figure 5:
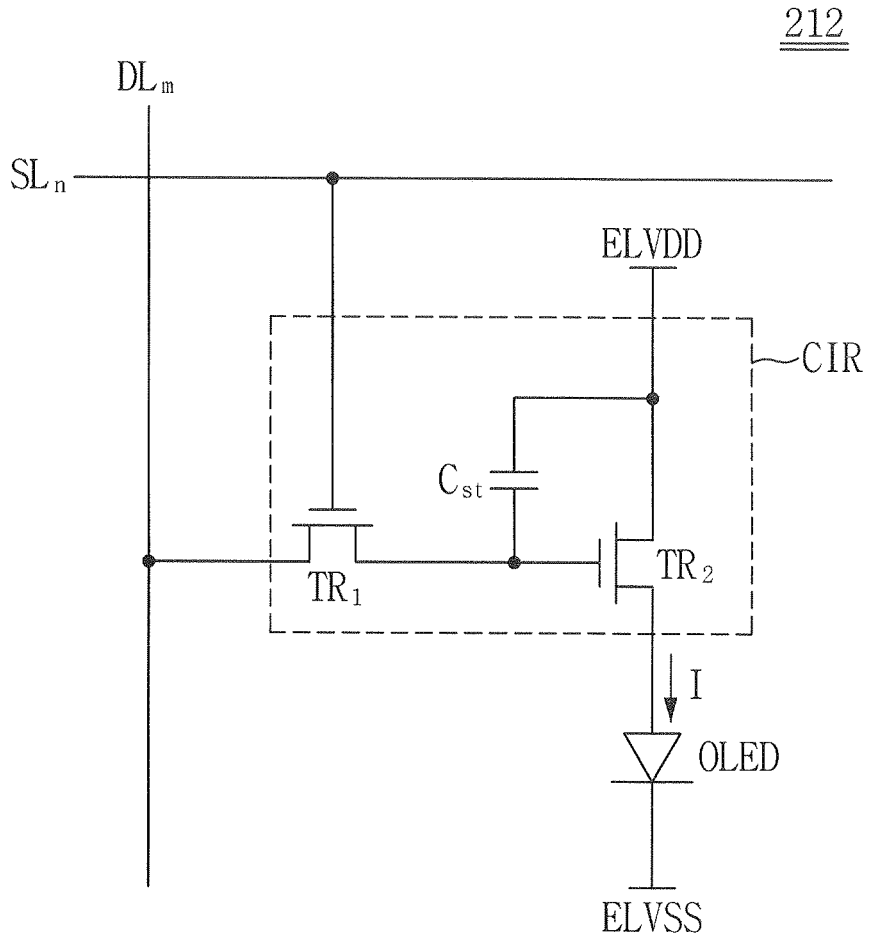
FIG. 5 is a circuit diagram illustrating a pixel circuit of the display device of FIG. 4.

FIG. 5 is a circuit diagram illustrating the pixel 212 of the display device 200 of FIG. 4. For ease of description, a pixel 212 connected to the mth data line DLm and the nth scan line SLn is illustrated.

Referring to FIG. 5, the pixel 212 may include an OLED and a pixels circuit CIR applying current to the OLED. The pixel circuit CIR may include two transistors TR1 and TR2 and one capacitor Cst. However, embodiments of the present invention are not limited thereto, and thus one pixel may include a proper number of transistors and capacitors as necessary.

The transistors TR1 and TR2 may be low temperature polycrystalline silicon (LTPS) thin film transistors TFTs, but embodiments of the present invention are not limited thereto.

An anode electrode of the OLED is connected to the pixel circuit CIR and a cathode electrode is connected to a ground power applying a ground voltage ELVSS. Accordingly, light corresponding to current supplied from the pixel circuit CIR is emitted from the OLED.

The pixel circuit CIR receives a data signal from a data line DLm when a scan signal is supplied from a scan line. In a case where the scan signal is applied over the scan line SLn, a first transistor TR1 is turned on, and the data signal supplied over the data line DLm is applied to a gate electrode of the second transistor TR2. That is, the data signal supplied from the first transistor TR1 is a signal for controlling a turned-on or turned-off state of the second transistor TR2.

In a case where the second transistor TR2 is turned on in response to the data signal supplied via the first transistor TR1, a driving power ELVDD is applied to the anode electrode of the OLED and current I thus flows through the OLED. Accordingly, the OLED may emit light. In this case, an amount of current I varies depending on voltage values applied to two end portions of the OLED, that is, the driving power ELVDD and a ground power ELVSS.

In a case where the second transistor TR2 is turned off, the anode electrode of the OLED floats, such that light becomes extinguished in the OLED. Meanwhile, the capacitor Cst stores a voltage equivalent to a voltage difference between the driving power ELVDD and a voltage of the data signal, such that the second transistor TR2 may maintain a turned-on or turned-off state while the first transistor TR1 is turned off and the data signal is not applied.

Luminance of the light emitted from the pixel 212 is determined by an emitting duration, that is, a light emitting time of the OLED, and a current value of the current I which flows when the light is emitted. Luminance of the light emitted from the pixel 212 is increased, as an emitting duration of the pixel 212 in one frame period increases and as a current value proportional to a voltage value of the driving power ELVDD increases.

Figure 6:
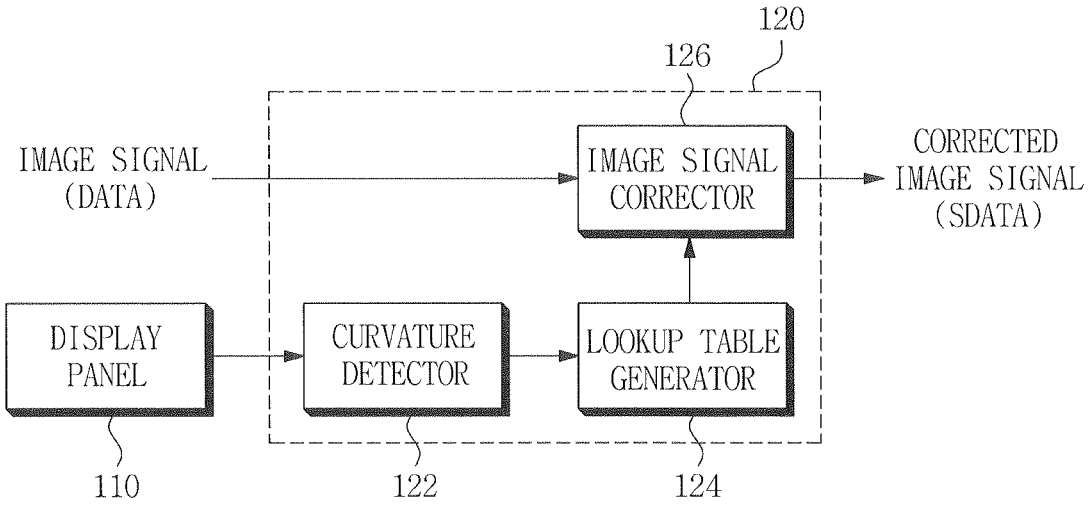
FIG. 6 is a block diagram illustrating a controller of the display device of FIG. 2.

Referring to FIG. 6, the controller 120 includes a curvature detector 122 and a lookup table generator 124.

The curvature detector 122 is configured to detect a radius of curvature of the display panel 110 that is outputted from the outside and transmits the detected radius of curvature to the lookup table generator 124. For example, in a case where a display panel of which the radius of curvature can be adjusted in a range of 1500 R to 6000 R is used and a user adjusts the radius of curvature to 2000 R, the curvature detector 122 detects this and transmits the value to the lookup table generator 124.

The lookup table generator 124 is configured to generate a correction lookup table based on the radius of curvature transmitted from the curvature detector 122.

The lookup table generator 124 may generate correction lookup tables based on a plurality of reference correction data corresponding to different predetermined radii of curvatures that are premeasured. In this case, the plurality of reference correction data may be lookup tables.

For example, in a case where a display panel of which the radius of curvature can be adjusted in a range of 1500 R to 6000 R is used, a first reference correction data that is generated by comparing a luminance distribution of a display panel having a radius of curvature of 1500 R with a luminance distribution of a flat display panel is compared with a second reference correction data that is generated by comparing a luminance distribution of a display panel having a radius of curvature of 6000 R and the luminance distribution in the flat display panel, such that correction lookup tables for the radii of curvatures in a range of 1500 R to 6000 R can be generated, accordingly. In this case, if an interpolation method is used based on more reference correction data of predetermined radii of curvatures, a more accurate correction lookup table may be generated.

The interpolation may be one of linear interpolation, polynomial interpolation, and spline interpolation, but is not limited thereto and a proper interpolation method may be used.

Hereinafter, a method of measuring the reference correction data will be described. Firstly, an image signal having a predetermined gray level is provided to a display panel having a predetermined radius of curvature and a luminance distribution of the display panel is measured by a luminance measuring device, such as a camera. Then, the measured luminance distribution is analyzed to determine and separate the number of duplicated luminance profiles of smears. An area and form of the respective smears corresponding to the separated luminance profiles are examined, and an amount of smear correction with respect to image signals in a normal luminance area of the flat display panel is calculated and stored as a lookup table. In a case where the smear has a higher luminance compared to a normal luminance area, an amount of smear correction may have a negative value to decrease luminance. In contrast, in a case where the smear has a lower luminance compared to a normal luminance area, an amount of smear correction may have a positive value to increase luminance.

The controller 120 may further include an image signal corrector 126 configured to multiply the correction data of the correction lookup table generated from the lookup table generator 124 and an image signal DATA to produce a corrected image signal SDATA.

Further, the controller 120 may further include an accurate color capture (ACC) tuner (not illustrated), a dynamic capacitance capture (DCC) tuner (not illustrated), and a control signal generator (not illustrated).

The ACC tuner may perform a gamma correction of the corrected image signal SDATA based on a predetermined correction gamma value according to a gamma property of the display device. For example, in the condition that the same gray level is displayed and that blue image data has the highest luminance value, red image data has the lowest luminance value, and green image data has a luminance value in the middle of the two luminance values, the correction gamma value is added or subtracted to compensate for a luminance difference.

The DCC tuner may correct a gray value of the corrected image data SDATA of the current frame based on a DCC correction value predetermined according to a gray-level difference between the corrected image signal SDATA of the current frame and the corrected image signal SDATA of the previous frame, in order to improve a response speed of the current frame.

The control signal generator may generate a data control signal DCS and a scan control signal SCS based on a control signal CS supplied from the outside.

Figure 7:
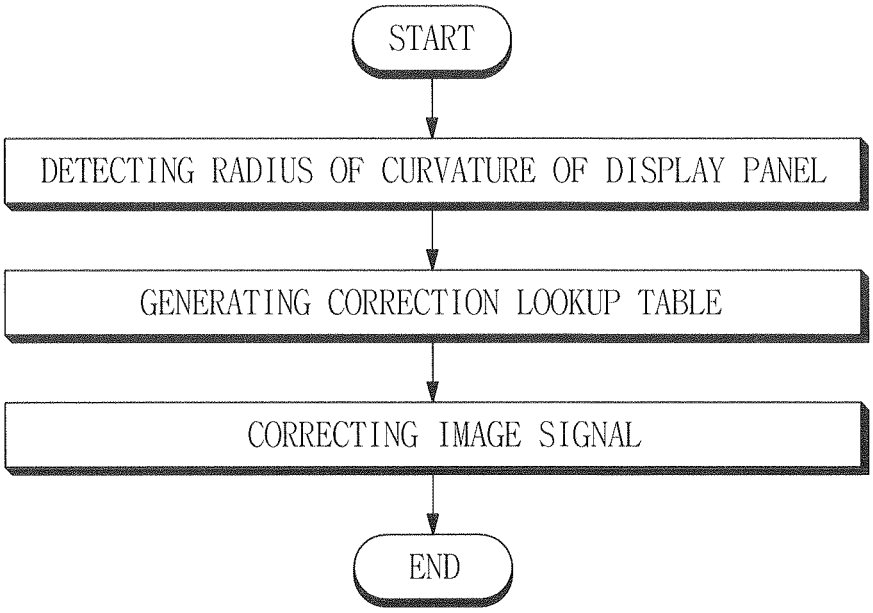
FIG. 7 is a flow chart for explaining a method of driving the display device according to an embodiment of the present invention.

Referring to FIG. 7, a method of driving the display device according to an embodiment of the present invention includes: detecting a radius of curvature of the display panel; generating a correction lookup table for correcting an input image signal based on the radius of curvature; and correcting the image signal based on the correction lookup table.

The correction lookup table may be generated based on a plurality of reference correction data for different predetermined radii of curvatures that are premeasured. In this case, the correction lookup table may be generated based on the plurality of reference correction data by employing a variety of interpolation methods, such as linear interpolation, polynomial interpolation, and spline interpolation.

The repeated description described for FIGS. 2 to 6 will not be provided for FIG. 7, for ease of description.

From the foregoing, it will be appreciated that various embodiments in accordance with the present disclosure have been described herein for purposes of illustration, and that various modifications may be made without departing from the scope and spirit of the present teachings. Accordingly, the various embodiments disclosed herein are not intended to be limiting of the true scope and spirit of the present teachings.

What is claimed is:

1. A display device, comprising:

a curvature-variable display panel comprising a plurality of pixels;

a controller configured to correct luminance of an image signal supplied from an external source according to a radius of curvature of the display panel and to output the corrected image signal;

a data driver configured to supply a data signal corresponding to the corrected image signal to a data line connected to the pixel; and a scan driver configured to supply a scan signal synchronized with the data signal to a scan line connected to the pixel, wherein the controller comprises:

a curvature detector connected to the curvature-variable display panel, the curvature detector configured to detect the radius of curvature of the display panel; and a lookup table generator connected to the curvature detector, the radius of curvature of the display panel being transmitted to the lookup table generator from the curvature detector, the lookup table generator configured to generate a luminance correction lookup table according to the radius of curvature of the display panel.

2. The display device of claim 1, wherein the lookup table generator generates the luminance correction lookup table based on a plurality of reference correction data corresponding to different predetermined radii of curvatures that are premeasured.

3. The display device of claim 2, wherein the luminance correction lookup table is generated based on the plurality of reference correction data using an interpolation method.

4. The display device of claim 3, wherein the interpolation method is one of linear interpolation, polynomial interpolation, and spline interpolation.

5. The display device of claim 1, wherein the controller further comprises an image signal corrector configured to correct the image signal by multiplying correction data of the luminance correction lookup table.

6. A method of driving a display device, the method comprising:

detecting a radius of curvature of a display panel by a curvature detector;

generating a luminance correction lookup table by a lookup table generator for correcting luminance of an input image signal based on the detected radius of curvature, the lookup table generator being connected to the curvature detector, the radius of the curvature of the display panel being transmitted to the lookup table generator from the curvature detector; and correcting the image signal based on the luminance correction lookup table.

7. The method of claim 6, wherein the luminance correction lookup table is generated based on a plurality of reference correction data corresponding to different predetermined radii of curvatures that are premeasured.

8. The method of claim 7, wherein the luminance correction lookup table is generated based on the plurality of reference correction data using an interpolation method.

9. The method of claim 8, wherein the interpolation method is one of linear interpolation, polynomial interpolation, and spline interpolation.

* * * * *